US008726455B2

(12) United States Patent
Kasper

(10) Patent No.: US 8,726,455 B2
(45) **Date of Patent: *May 20, 2014**

(54) SURFACE CLEANING APPARATUS WITH HYBRID ALUMINUM HEATER

(75) Inventor: Gary A. Kasper, Grand Rapids, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/155,960

(22) Filed: Jun. 8, 2011

(65) Prior Publication Data

US 2011/0232023 A1 Sep. 29, 2011

Related U.S. Application Data

(60) Continuation of application No. 12/346,256, filed on Dec. 30, 2008, now Pat. No. 8,621,708, which is a division of application No. 11/276,167, filed on Feb. 16, 2006, now Pat. No. 7,784,148.

(60) Provisional application No. 60/743,153, filed on Jan. 20, 2006, provisional application No. 60/593,829, filed on Feb. 17, 2005.

(51) Int. Cl.
*A47L 7/00* (2006.01)

(52) U.S. Cl.
USPC ..... 15/320

(58) Field of Classification Search
USPC ..... 15/320, 321, 337, 366
See application file for complete search history.

(56) References Cited

U.S. PATENT DOCUMENTS

| | | | | |
|---|---|---|---|---|
| 5,265,318 | A * | 11/1993 | Shero | 29/447 |
| 6,131,237 | A * | 10/2000 | Kasper et al. | 15/320 |
| 6,941,064 | B2 * | 9/2005 | Thweatt, Jr. | 392/488 |
| 7,784,148 | B2 * | 8/2010 | Lenkiwicz et al. | 15/322 |
| 2004/0197095 | A1 | 10/2004 | Thweatt, Jr. | |

* cited by examiner

*Primary Examiner* — Robert Scruggs
(74) *Attorney, Agent, or Firm* — McGarry Bair PC

(57) ABSTRACT

A surface cleaning apparatus comprises a fluid delivery system including a supply of cleaning fluid stored in a fluid supply chamber and a fluid recovery system for drawing dirty cleaning fluid using suction from the surface to be cleaned. The apparatus has an inline fluid heater having a metal body with an embedded heating element and a polymeric cover provided with a fluid inlet fitting and a fluid outlet fitting. The fluid inlet and fluid outlet fittings are preferably integrally molded with the polymeric cover.

12 Claims, 4 Drawing Sheets

SURFACE CLEANING APPARATUS WITH HYBRID ALUMINUM HEATER

CROSS-REFERENCE TO RELATED APPLICATIONS

This application is a continuation of Ser. No. 12/346,256, filed Dec. 30, 2008, now U.S. Pat. No. 8,621,708, issued Jan. 7, 2014, which is a divisional application of Ser. No. 11/276,167, filed Feb. 16, 2006, now U.S. Pat. No. 7,784,148, which claims the benefit of U.S. Provisional Patent Application No. 60/593,829, filed Feb. 17, 2005, and U.S. Provisional Patent Application No. 60/743,153, filed Jan. 20, 2006, all of which are incorporated herein by reference in their entirety.

BACKGROUND OF THE INVENTION

1. Field of the Invention

The invention relates to a surface cleaning apparatus that fluid cleaning system to deliver heated cleaning fluid to a surface to be cleaned. In one of its aspects, the invention relates to a surface cleaning apparatus that has an inline heater to heat cleaning fluid.

2. Description of the Related Art

Extractors are well-known devices for deep cleaning carpets and other fabric surfaces, such as upholstery. Most carpet extractors comprise a fluid delivery system and a fluid recovery system. The fluid delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. The fluid recovery system usually comprises a recovery tank, a nozzle adjacent the surface to be cleaned and in fluid communication with the recovery tank through a working air conduit, and a source of suction in fluid communication with the working air conduit to draw the cleaning fluid from the surface to be cleaned and through the nozzle and the working air conduit to the recovery tank. An example of an extractor is disclosed in commonly assigned U.S. Pat. No. 6,131,237 to Kasper et al., which is incorporated herein by reference in its entirety. The Kasper et al. '237 includes an aluminum body that includes a cover made of aluminum and further includes a fluid inlet fitting and a fluid outlet fitting connected to the metal body for circulating fluid through the metal body. Corrosion may be a problem resulting from casting the fluid inlet and fluid outlet fittings into the metal heater block. This problem might be overcome the use screw-in fittings with an O-ring rather than casting the fittings into the block. This solution may reduce the corrosion problem but may also add significant cost in that the block is required to be tapped and a hand assembly is required for threading the fittings into the tapped holes. Further, the metal cover may have to be Teflon coated to avoid corrosion problems.

The U.S. Patent Application Publication No. 2004/0197095 to Thweatt, Jr. discloses a heater for fluids including a housing made of non-metallic material and having an internal cavity and an inlet and an outlet in fluid communication with the internal cavity. The heater housing is made of a polymeric material. A heating element is suspended within the cavity for heating fluid flowing therethrough. Further, the heating element comprises a U-shaped portion and electrical connectors at opposite ends of the heating element which extend through the housing. Thweatt, Jr. '095 has fluid inlet and outlet fittings mounted to the heating element in an end wall of the plastic housing. The heating element may melt the walls of the plastic housing when the housing is dry, regardless of the existence of a thermal cutoff control.

SUMMARY OF THE INVENTION

A surface cleaning apparatus according to the invention comprises a housing, a fluid delivery system mounted to the housing and including a fluid supply chamber for holding a supply of cleaning fluid, a fluid dispenser for applying cleaning fluid from the fluid supply chamber to the surface to be cleaned, and a fluid supply conduit between the fluid supply chamber and the fluid dispenser. The apparatus further comprises a fluid recovery system mounted to the housing and including a suction nozzle and a vacuum source in fluid communication with the suction nozzle to draw dispensed fluid from the surface to be cleaned through the suction nozzle.

According to one embodiment of the invention, the apparatus further comprises an in-line fluid heater comprising a metal body with an embedded heating element and a polymeric cover with a fluid inlet fitting and a fluid outlet fitting connected in-line with the fluid supply conduit.

In another embodiment of the invention, the fluid inlet and outlet fittings of the heater are integrally molded with the cover.

In yet another embodiment of the invention, the metal body of the heater forms a fluid channel having an open upper end, and the cover closes the open upper end of the fluid channel to form a closed fluid channel in the fluid heater.

According to yet another embodiment of the invention, the heater cover is secured to the body of the heater with mechanical fasteners and a gasket located between the cover and the body.

DESCRIPTION OF THE PREFERRED EMBODIMENT

Figure 1:
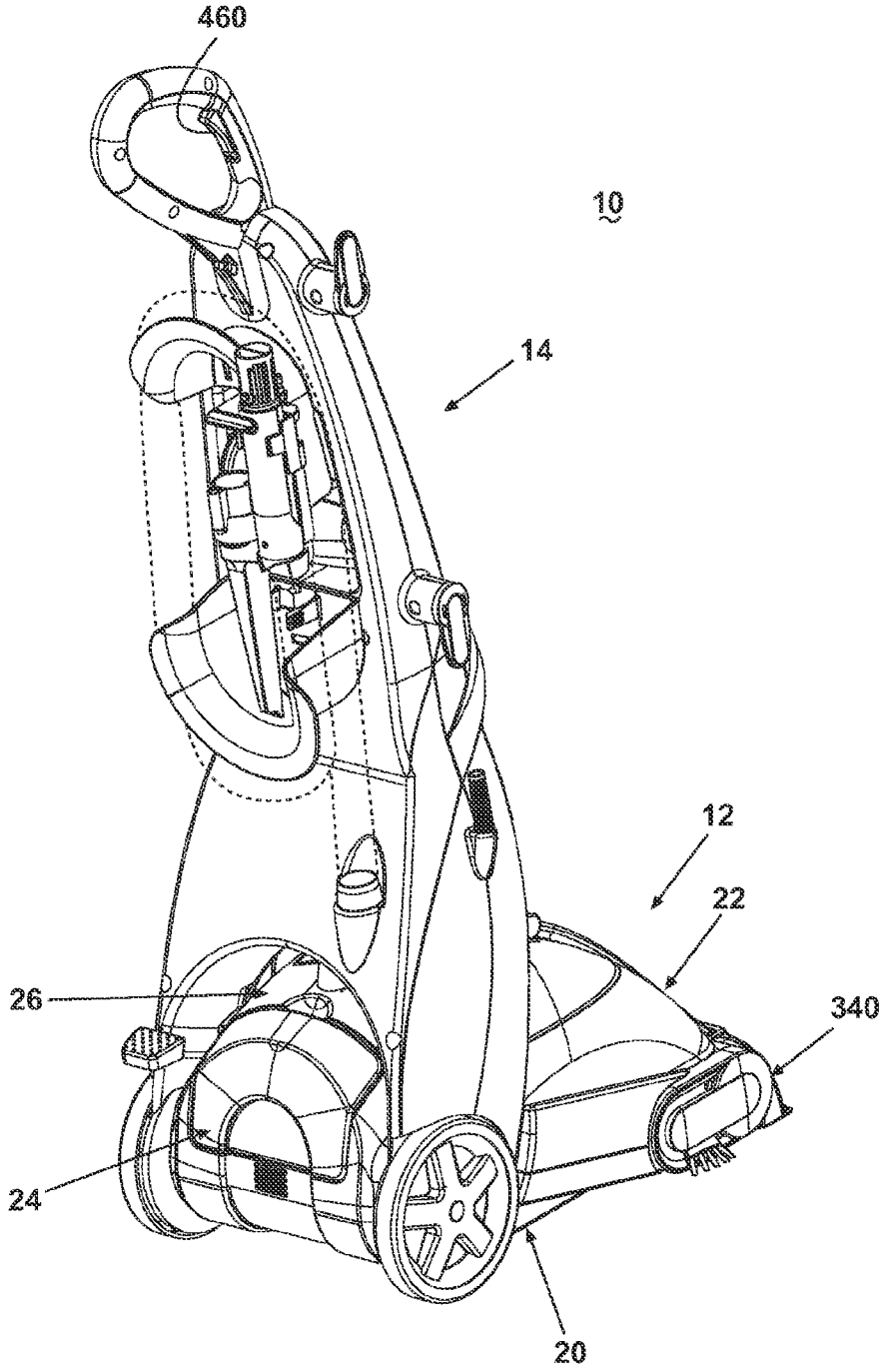
FIG. 1 is a rear, left perspective view of an extractor according to the invention with a handle assembly pivotally mounted to a foot assembly.

Referring now to the drawings and particularly to FIG. 1, an upright extractor 10 according to the invention comprises a housing having a foot assembly 12 for movement across a surface to be cleaned and a handle assembly 14 pivotally mounted to a rearward portion of the foot assembly 12 for directing the foot assembly 12 across the surface to be cleaned. The extractor 10 includes a fluid delivery system for storing cleaning fluid and delivering the cleaning fluid to the surface to be cleaned and a fluid recovery system for removing the spent cleaning fluid and dirt from the surface to be cleaned and storing the spent cleaning fluid and dirt. The components of the fluid delivery system and the fluid recovery system are supported by at least one of the foot assembly 12 and the handle assembly 14. Details of the extractor 10 are more fully described in parent U.S. Patent Application Publication No. 2009/0101187, filed Dec. 30, 2008, entitled "Surface Cleaning Apparatus with Cleaning Fluid Supply", which is incorporated herein by reference in its entirety.

The foot assembly 12 comprises a base assembly 20 that supports a recovery tank assembly 22 at a forward portion thereof and a solution supply tank assembly 24 at a rearward portion thereof. Further, a nozzle assembly 340 is removably mounted to a forward portion of the base assembly 20.

Figure 2:
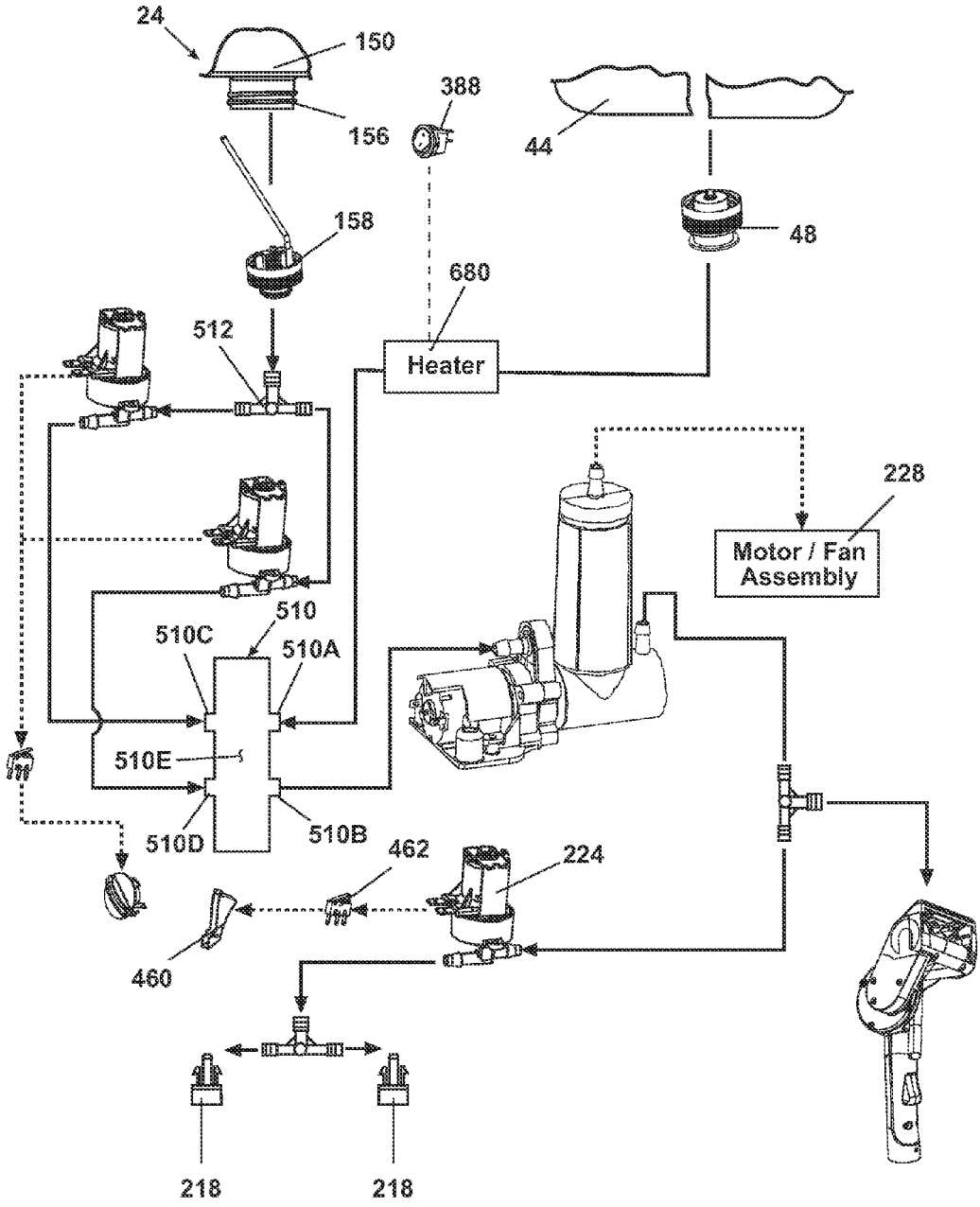
FIG. 2 is a schematic view of a fluid delivery system for the extractor of FIG. 1.

Referring to FIGS. 1 and 2, the extractor 10 comprises the fluid recovery system for removing the spent cleaning fluid and dirt from the surface to be cleaned and storing the spent cleaning fluid and dirt. The nozzle assembly 340 forms a portion of the fluid flow path, the opening of which is positioned adjacent a surface to be cleaned. When the nozzle assembly 340 and the recovery tank assembly 22 are mounted to the base assembly 20, a continuous working air path is formed through the nozzle assembly 340 and the recovery tank assembly 22. A vacuum is drawn on the recovery tank assembly 22 and nozzle assembly 340 by a motor and fan assembly 228 to draw spend cleaning fluid from the surface to be cleaned.

The solution supply tank assembly 24 is removably mounted to the base assembly 20. The solution supply tank assembly 24 comprises a solution supply tank housing 150 that defines a solution supply chamber (not shown). The solution supply tank housing has outlet 156 in a bottom wall thereof. The outlet 156 receives a valve mechanism 158 for controlling flow of fluid from the solution supply chamber 152. Spray tips 218 are in fluid communication with solution supply chamber 152 so that the fluid can be supplied from the spray tips 218 to the surface to be cleaned.

As mentioned above, the extractor 10 comprises the fluid delivery system for storing the cleaning fluid and delivering the cleaning fluid to the surface to be cleaned. For visual clarity, the various electrical and fluid connections within the fluid delivery system are not shown in the drawings described above but are depicted schematically in FIG. 2. Referring now to FIG. 2, the fluid delivery system comprises a bladder 44 for storing a first cleaning fluid and the solution supply tank housing 150 of the solution supply tank assembly 24 for storing a second cleaning fluid. The first and second cleaning fluids are dispensed from the bladder 44 and the solution supply tank housing 150 through respective valve mechanisms 48, 158, which are received by respective valve seats (not shown) when the recovery tank assembly 22 and the solution supply tank assembly 24, respectively, are mounted to the base assembly 20. The first cleaning fluid flows from the bladder 44 and through a heater 680, which heats the first cleaning fluid when the heater 680 is activated through a heater switch 388, to a mixing manifold 510. The mixing manifold 510 forms a conduit for the first cleaning fluid between a first fluid inlet 510A and an outlet 510B and also includes two second cleaning fluid inlets 510C, 510D. The second cleaning fluid inlets 510C, 510D fluidly communicate with the conduit for the first cleaning fluid in a mixing chamber 510E. The heater 680 can heat fluids and is preferably an in-line heater. Exemplary valve mechanisms and heaters are disclosed in U.S. Pat. No. 6,131,237 and U.S. patent application Ser. No. 60/521,693, which are incorporated herein by reference in their entirety.

In operation, when a user depresses a fluid trigger 460 on the handle assembly 14, a trigger switch 462 opens a spray tip valve 224 to deliver cleaning fluid to the spray tips 218 for dispensation onto the surface to be cleaned.

Figure 3:
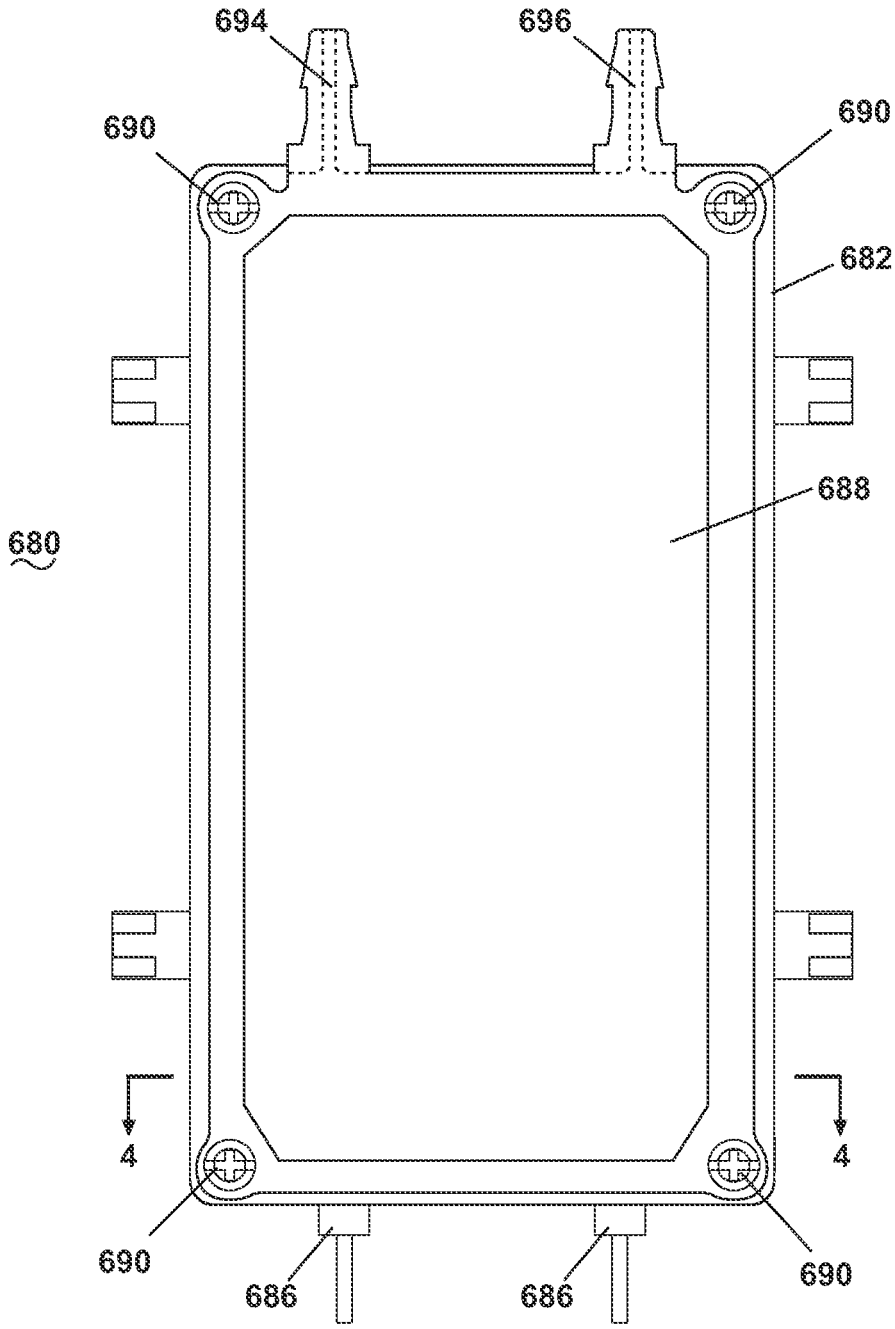
FIG. 3 is a top view of a heater for use with the fluid delivery system of FIG. 2.
Figure 4:
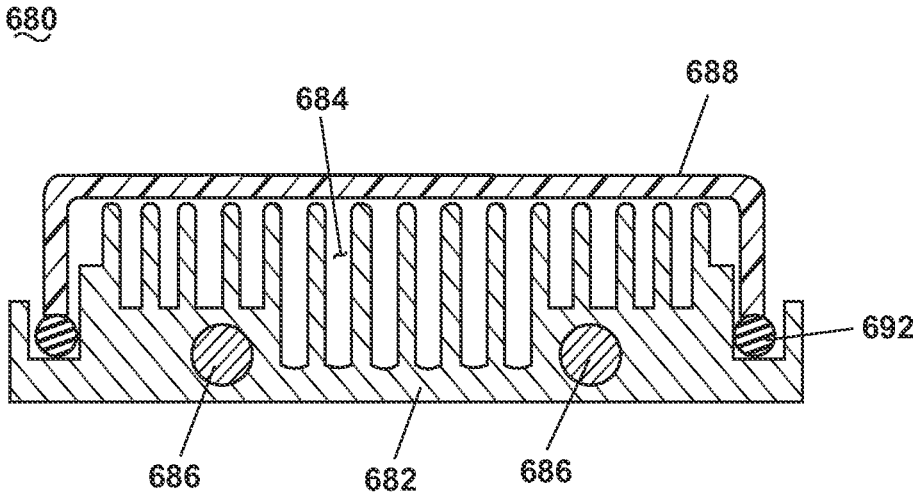
FIG. 4 is a sectional view taken along line 4-4 of FIG. 3.

The heater 680 for heating the cleaning fluid is illustrated in FIGS. 3 and 4. The heater 680 is similar to the heater disclosed in the aforementioned and incorporated U.S. Pat. No. 6,131,237 in that the heater 680 comprises a metallic body 682, such as an aluminum body, that forms a serpentine fluid channel 684 with an open upper end and houses a heating element 686. The heater 680 further comprises a polymeric cover 688 mounted to the body 682 by mechanical fasteners 690, such as screws, with a gasket 692 therebetween. The cover 688 comprises a fluid inlet port 694 and a fluid outlet port 696, which are preferably integrally molded with the cover 688. When the cover 688 is mounted to the body 682, the cover 688 closes the open upper end of the fluid channel 684, and the fluid inlet port 694 and the fluid outlet port 696 provide an inlet and an outlet, respectively, to the fluid channel 684. During operation, the cleaning fluid flows through the fluid inlet port 694 into the fluid channel 684 and exits the fluid channel 684 through the fluid outlet port 696. As the cleaning fluid flows through the fluid channel 684, heat from the heating element 686 conducts through the body 682 and to the cleaning fluid to thereby heat the cleaning fluid.

The hybrid heater 680 according to the invention uses a metal block (body 682) with an embedded heating element 686 for efficient heat transfer but eliminates a metal cover and integrally forms the inlet and outlet ports 694, 696 with the plastic cover 688. Thus, the invention avoids the corrosion problems of the prior art while maintaining the heat transfer properties of the prior art and eliminates expensive machining operations, hand assembly and Teflon coating of the cover. The metal body 682 with the embedded heating element 686 stores heat energy and gives a thermal sensor the time to react. Thus, the invention involves the combination of a plastic cover that mounts the inlet and outlet ports 694, 696, preferably by integral molding.

The various features of the extractor 10 described here are not limited for use in an upright extractor. Rather, the features can be employed for any suitable surface cleaning apparatus, including, but not limited to, hand-held extractors, canister extractors, upright and canister vacuum cleaners, shampooing machines, mops, bare floor cleaners, and the like.

While the invention has been specifically described in connection with certain specific embodiments thereof, it is to be understood that this is by way of illustration and not of limitation. Reasonable variation and modification are possible within the scope of the forgoing description and drawings without departing from the spirit of the invention which is defined in the appended claims.

What is claimed is:

1. An extraction surface cleaning apparatus comprising:
- a housing;
- a fluid delivery system mounted to the housing and including:
  - a fluid supply chamber for holding a supply of cleaning fluid;
  - a fluid dispenser for applying cleaning fluid from the fluid supply chamber to the surface to be cleaned;
  - a fluid supply conduit between the fluid supply chamber and the fluid dispenser; and
  - an in-line fluid heater comprising:
    - a metal body with an embedded heating element; and
    - a polymeric cover with a polymeric fluid inlet fitting and a polymeric fluid outlet fitting, the inlet and outlet fittings being connected in-line with the fluid supply conduit; and
- a fluid recovery system mounted to the housing and including a suction nozzle and a vacuum source in fluid communication with the suction nozzle to draw dispensed fluid from the surface to be cleaned through the suction nozzle.

2. The extraction surface cleaning apparatus according to claim 1 wherein the fluid inlet fitting and the fluid outlet fitting are integrally molded with the cover from the same polymeric material as the cover.

3. The extraction surface cleaning apparatus according to claim 2 wherein the metal body forms a fluid channel having an open upper end, and the cover closes the open upper end of the fluid channel to form a closed fluid channel in the fluid heater.

4. The extraction surface cleaning apparatus according to claim 3 wherein the fluid inlet fitting and the fluid outlet fitting form a fluid inlet and a fluid outlet, respectively, for the closed fluid channel.

5. The extraction surface cleaning apparatus according to claim 3 wherein the fluid channel is a serpentine fluid channel.

6. The extraction surface cleaning apparatus according to claim 2 wherein the cover is secured to the body with mechanical fasteners and a gasket located between the cover and the body.

7. The extraction surface cleaning apparatus according to claim 2 wherein the polymeric material is plastic.

8. The extraction surface cleaning apparatus according to claim 1 wherein the metal body forms a fluid channel having an open upper end, and the cover closes the open upper end of the fluid channel to form a closed fluid channel in the fluid heater.

9. The extraction surface cleaning apparatus according to claim 8 wherein the fluid inlet fitting and the fluid outlet fitting form a fluid inlet and a fluid outlet, respectively, for the closed fluid channel.

10. The extraction surface cleaning apparatus according to claim 8 wherein the fluid channel is a serpentine fluid channel.

11. The extraction surface cleaning apparatus according to claim 1 wherein the cover is secured to the body with mechanical fasteners and a gasket located between the cover and the body.

12. The extraction surface cleaning apparatus according to claim 1 wherein the polymeric cover, polymeric fluid inlet fitting, and polymeric fluid outlet fitting are plastic.

* * * * *